US005904135A

United States Patent [19]

Summers et al.

[11] Patent Number: 5,904,135

[45] Date of Patent: May 18, 1999

[54] BOWSTRING NOCK/RELEASE LOOP ASSEMBLY

[75] Inventors: Gregory E. Summers, 105 Overlink Ct., Lynchburg, Va. 24503; Randy Summers, Madison Heights, Va.; Jack Tyree, Beckley, W. Va.

[73] Assignee: Gregory E. Summers, Lynchburg, Va.

[21] Appl. No.: 09/002,780

[22] Filed: Jan. 5, 1998

[51] Int. Cl.[6] ..... F41B 5/14

[52] U.S. Cl. ..... 124/91

[58] Field of Search ..... 124/35.2, 90, 91

[56] References Cited

U.S. PATENT DOCUMENTS

| | | | |
|---|---|---|---|
| 2,819,707 | 1/1958 | Kayfes et al. . | |
| 2,905,166 | 9/1959 | Niemeyer . | |
| 3,847,133 | 11/1974 | Awiszus . | |
| 4,086,904 | 5/1978 | Suski et al. | 124/90 |
| 4,134,369 | 1/1979 | Cook . | |
| 4,151,825 | 5/1979 | Cook . | |
| 4,509,497 | 4/1985 | Garvison . | |
| 4,539,968 | 9/1985 | Garvison . | |
| 4,656,994 | 4/1987 | Jenks . | |
| 4,791,908 | 12/1988 | Pellis . | |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,170,772 | 12/1992 | Hamm | 124/35.2 |
| 5,247,921 | 9/1993 | Todd | 124/35.2 |
| 5,361,747 | 11/1994 | Laabs | 124/91 |
| 5,499,620 | 3/1996 | Summers | 124/91 |
| 5,537,986 | 7/1996 | Summers | 124/91 |
| 5,680,851 | 10/1997 | Summers | 124/35.2 |

*Primary Examiner*—John A. Ricci
*Attorney, Agent, or Firm*—Nixon & Vanderhye P.C.

[57] ABSTRACT

A bowstring nock and rope release loop assembly for attachment to a bowstring includes a bowstring nock having a pair of axially spaced bowstring attachment portions connected by a rigid cross-support; and a rope release loop adapted to be secured to the bowstring at opposite ends of the bowstring nock, closely adjacent the attachment clamps.

19 Claims, 7 Drawing Sheets

BOWSTRING NOCK/RELEASE LOOP ASSEMBLY

This invention relates generally to archery bows, and particularly to new and improved combination bowstring and nock release loop assemblies.

BACKGROUND OF THE INVENTION

In the field of archery, it is conventional for an arrow to be provided at its rearward end with a string engaging fork also known as an arrow nock. It is also known to provide a bowstring nock which locates the arrow nock on the bowstring to facilitate good aim of the arrow. Accordingly, the bowstring nock must be located on the bowstring substantially at the center of the string and substantially horizontally aligned with the point at which the forward end of the arrow is supported at the center of the bow. Representative bowstring nocks are described, for example, in U.S. Pat. Nos. 5,499,620; 5,361,747; 4,909,233; and 2,905,166.

It is also known to provide various forms of hand-held gripping and firing devices, also known as releases, designed to cooperate with the bowstring nock that enable an archer to apply a strong pull to the bowstring and to release the arrow without having to grip the end of the arrow and the bowstring with the fingers. See, for example, U.S. Pat. Nos. 5,016,603 and 4,930,485. See also my own recently issued U.S. Pat. Nos. 5,680,851 and 5,685,286.

SUMMARY OF THE INVENTION

In accordance with an exemplary embodiment of this invention, there is provided a new and improved combination bowstring nock and release loop. The bowstring nock includes a pair of vertically (or axially relative to the bowstring in a relaxed position) spaced bowstring attachment portions or clamps connected by a vertical cross-support or arrow nock engaging portion. Each of the bowstring attachment portions or clamps has a removable half clamp section which cooperates with mating clamp sections on the body of the nock to facilitate assembly of the bowstring nock to the bowstring. The fixed and removable clamp sections are also formed with axially aligned grooves which combine to form a pair of apertures adapted to receive the bowstring. The removable half sections and mating sections on the nock body have aligned fastener holes so that fastener screws can be employed to secure the respective removable half sections to the nock body half sections about the bowstring.

A length of rope having a diameter of about 1/16 to 1/8 inch is secured to the bowstring on either side of the bowstring nock, thereby creating a substantially C-shaped release loop extending rearwardly of the bowstring and which is adapted to be engaged by a conventional release device.

In a second exemplary embodiment, the rope release is incorporated into the bowstring nock so that no separate attachment of the rope to the bowstring is required. More specifically, the rope release is attached at opposite ends to a pair of attachment tabs formed on the vertically spaced, removable half clamp sections, thereby forming a substantially C-shaped rope release.

In accordance with its broader aspects, therefore, this invention provides a bowstring nock and rope release loop assembly for attachment to a bowstring, the assembly comprising a bowstring nock having a pair of axially spaced bowstring attachment portions connected by a rigid cross-support; and a rope release loop adapted to be secured to the bowstring at opposite ends of the bowstring nock, closely adjacent the attachment clamps.

In another aspect, the invention provides in combination with a bowstring, a bowstring nock having a pair of axially spaced bowstring attachment clamps connected by a rigid cross-support; the attachment clamps fixing the bowstring nock to the bowstring, with the cross-support extending substantially parallel to the bowstring; and a length of rope having free ends tied to the bowstring at opposite ends of the bowstring nock to thereby form a substantially C-shaped release loop adapted to be engaged by a release device.

In still another aspect, the invention provides a bowstring nock and rope release loop assembly for attachment to a bowstring, the assembly comprising: a bowstring nock having a pair of axially spaced bowstring attachment portions connected by a rigid cross-support; and a rope release having free ends attached to opposite ends of the bowstring attachment portions.

Other objects and advantages of the invention will become apparent from the detailed description which follows.

DETAILED DESCRIPTION OF THE INVENTION

Figure 1:
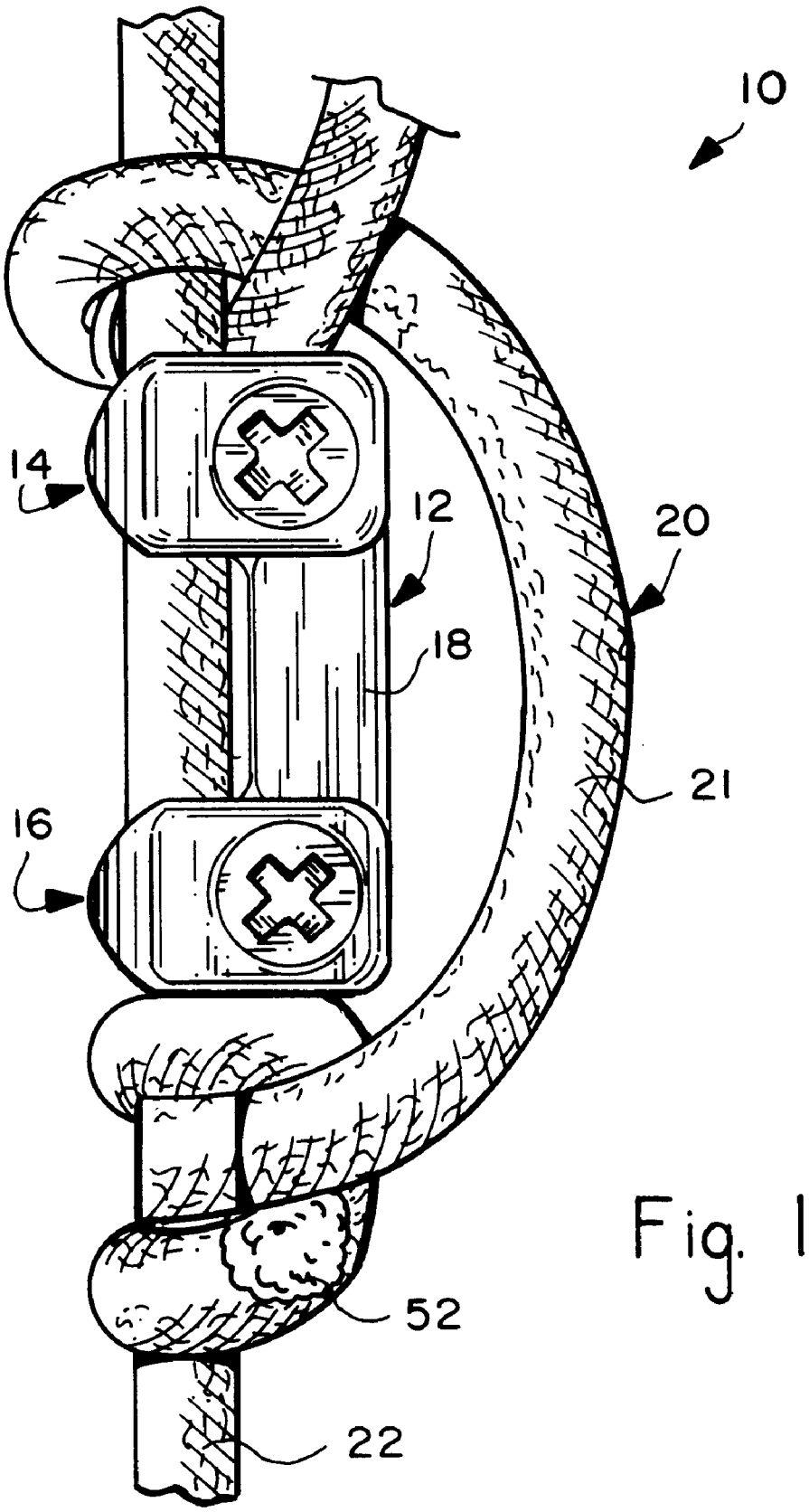
FIG. 1 is a side elevation of a combination bowstring nock and release loop assembly in accordance with a first exemplary embodiment of the invention.

With reference to FIG. 1, the combination bowstring nock and rope release assembly 10 includes a bowstring nock 12 which comprises a pair of bowstring engaging portions or clamps 14 and 16 separated by a vertically extending cross-support or arrow nock engaging portion 18. A rope release 20 is secured directly to the bowstring 22 on either side of the nock 12 so as to create a substantially C-shaped release loop 21 adapted to be engaged by the jaws of a conventional release mechanism (not shown), and drawn to the right as viewed in the Figure.

Figure 2:
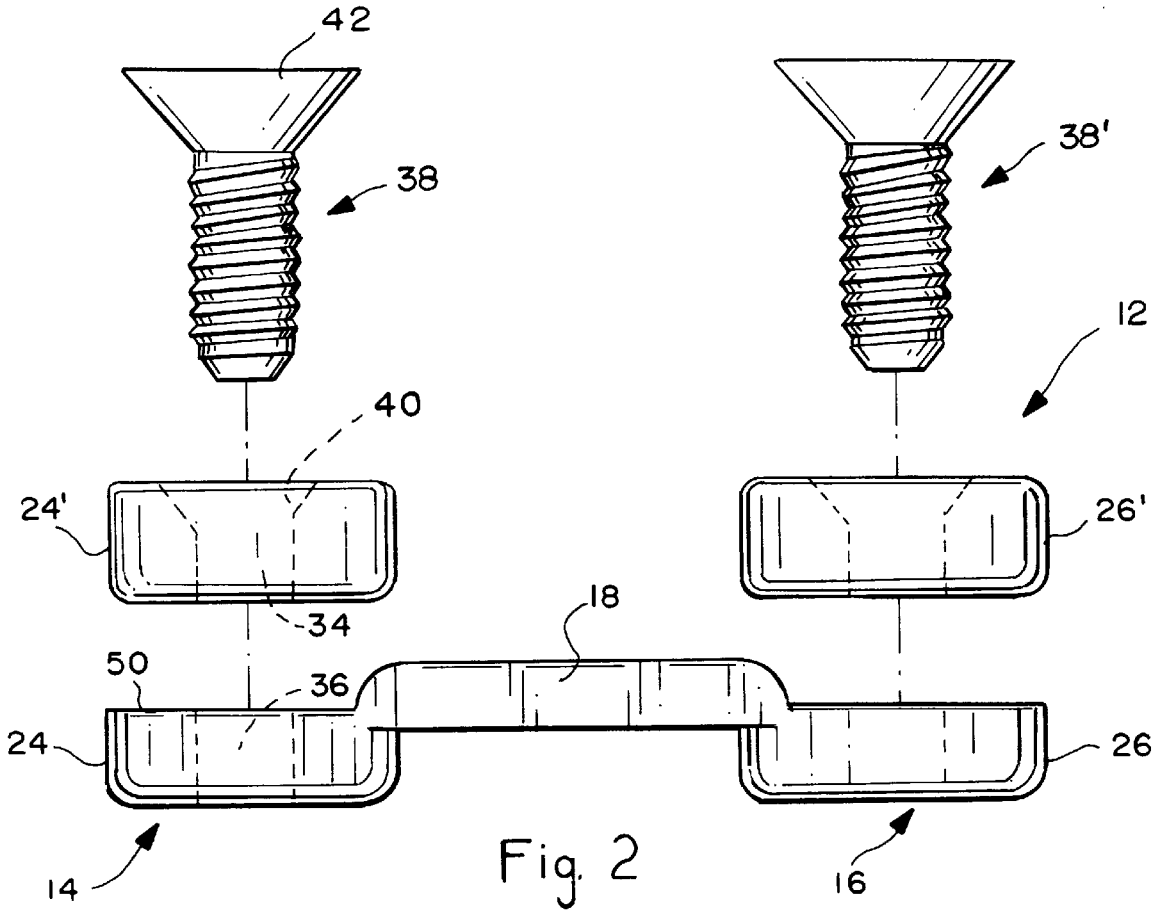
FIG. 2 is an elevation view, in exploded form, of the bowstring nock shown in FIG. 1.
Figure 3:
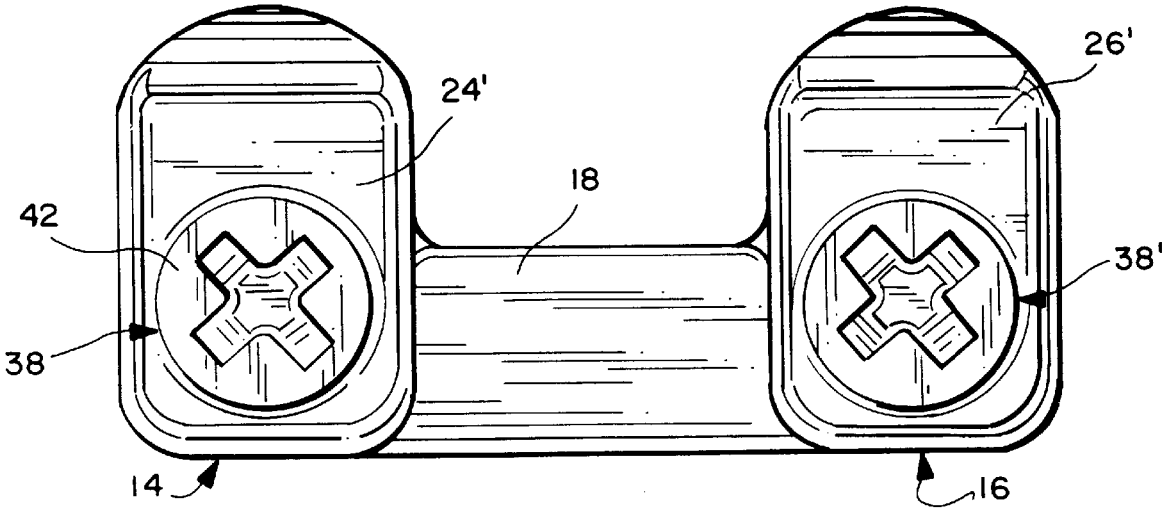
FIG. 3 is a plan view of the bowstring nock illustrated in FIG. 2, but with the components assembled.
Figure 4:
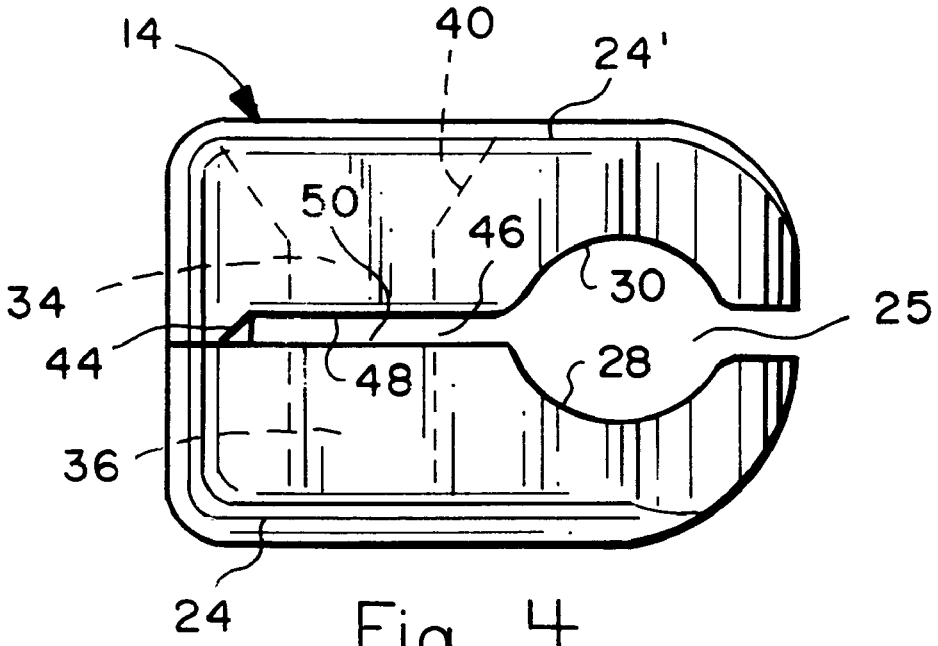
FIG. 4 is an end view of the bowstring nock illustrated in FIG. 3.
Figure 5:
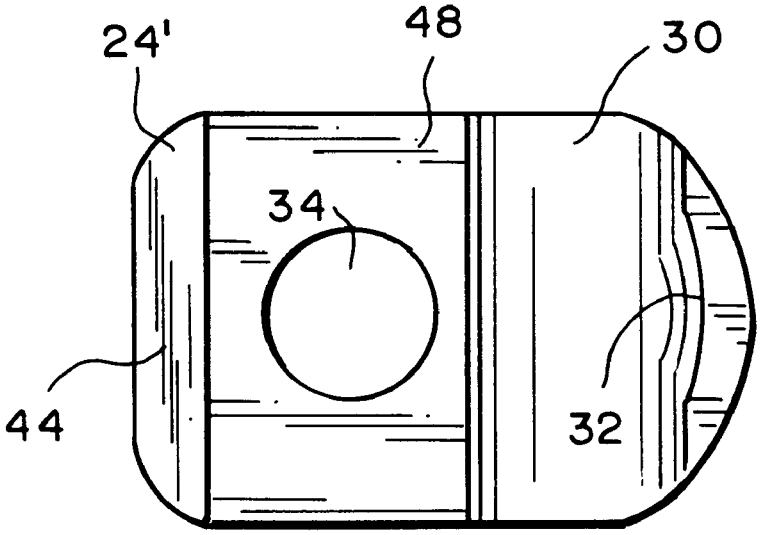
FIG. 5 is a bottom plan view of the separable upper component of the bowstring nock shown in FIG. 4.

Turning now to FIGS. 2–5, the bowstring nock 12 is shown in exploded form in FIG. 2. The bowstring nock includes a nock body comprising the cross-support 18 and two integral half clamp sections 24, 26 at opposite ends of the support, as well as two removable mating half clamp sections 24', 26', respectively. These components are preferably made of anodized aircraft aluminum, but other suitable metal or plastic may be employed. Since the bowstring engaging or clamping portions 14 and 16 are identical, only one need be described in detail. Thus, the bowstring engaging portion or clamp 14 includes a first half clamp section 24 and a mating separable half clamp section 24'. With reference also to FIG. 4, the separable half section 24' and the mating portion 24 each have respective half grooves 28 and 30 which, when assembled, combined to form a not quite round aperture 25 in which the bowstring is clamped so that the bowstring nock is prevented from moving axially along the length of the bowstring. Further in this regard, the half groove 30 includes an offset or recess 32 (FIG. 5) which enhances the gripping action or clamping of the bowstring. It will be appreciated that the half groove 28 may or may not have a similar offset.

The cooperating bowstring engaging half portions 24 and 24' also have aligned fastener holes 34, 36 which are adapted to receive a screw fastener 38, noting that the hole 34 is countersunk at 40 to receive the tapered head 42 of the fastener 38 in substantially flush relationship as shown in FIGS. 1 and 3, and that hole 36 is threaded.

It should also be noted that the separable half clamp section 24' has a raised edge 44 extending axially along one side thereof, remote from the groove portion 30. The raised edge 44 creates a gap 46 between the flat opposed surfaces 48, 50 of the half portions 24 and 24', respectively, as best seen in FIG. 4. This arrangement allows the separable half portion 24' to flex (particularly in the area of half groove 30) when the fastener 38 is tightened, thereby insuring greater clamping action on the bowstring 22 between half grooves 28, 30.

With specific reference to FIG. 2, the bowstring nock portion 18 is offset from the bowstring engaging portions 24, 26 so that when the mating bowstring engaging portions 24', 26' are secured by means of the screw fasteners 38, 38', the nock portion 18 is centered along the plane of the bowstring to insure accurate alignment with the arrow nock.

In a preferred arrangement, the nock 12 is formed of annodized aluminum, but other suitable metals or plastic materials may be employed.

Figure 6:
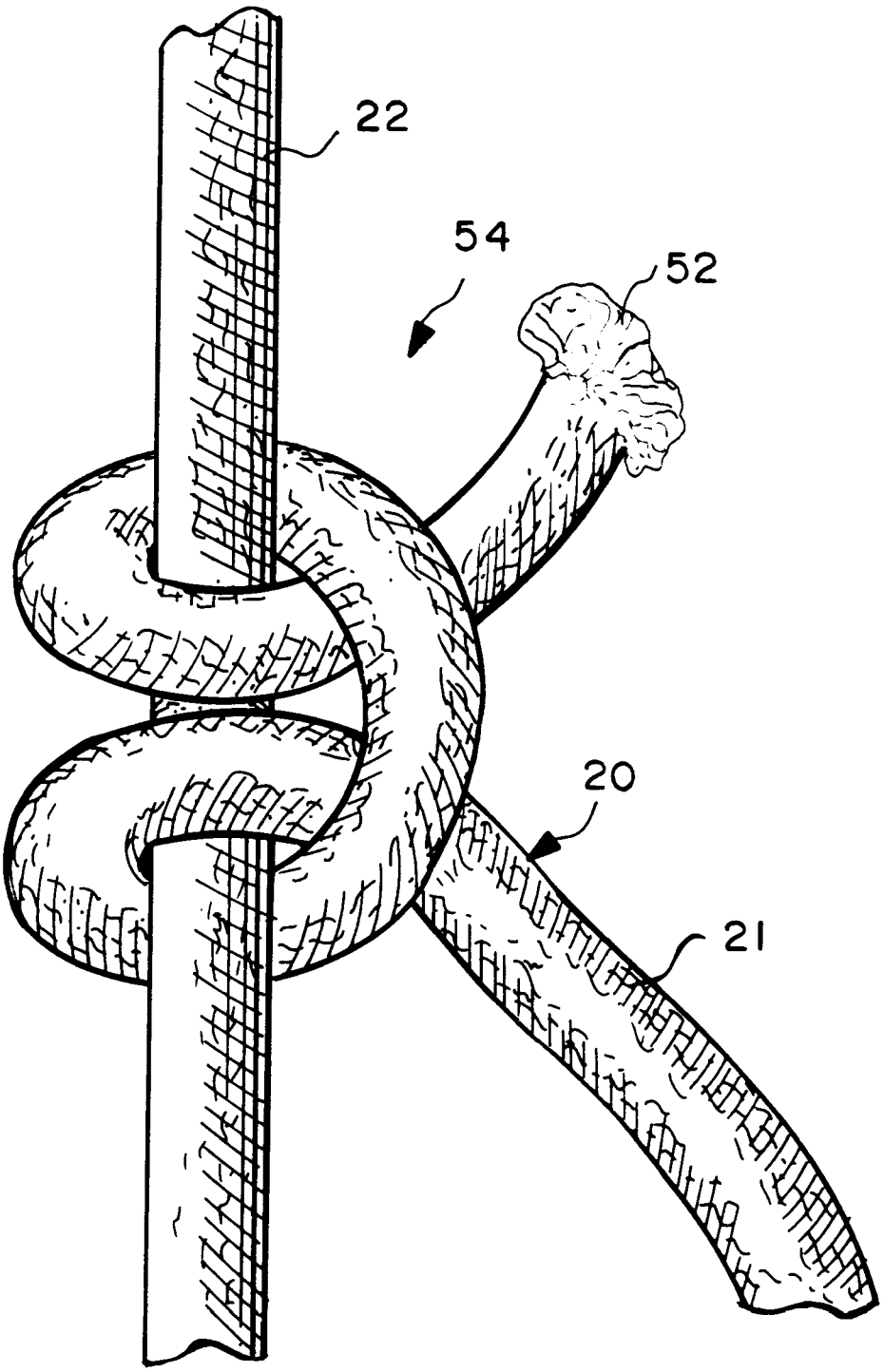
FIG. 6 is a side elevation illustrating the manner in which the release loop is secured to the bowstring in accordance with an exemplary embodiment of the invention.

With the bowstring nock 12 firmly clamped to the bowstring 22, the rope release 20 is secured to the bowstring 22 on either side of the nock 12 as best seen in FIG. 1. In order to insure secure attachment of the rope release 20 to the bowstring 22, I prefer to use a five inch rope, with frayed ends tapped to a ⅜ inch mushroom which is subsequently melted with a flame to form a large, relatively hard enlargement 52 at the ends of the rope, to thereby prevent loosening of the release knots. Each end of the rope is tied to the bowstring utilizing a half hitch knot 54 (FIG. 6) as shown in FIG. 6 (only partially shown in FIG. 1). Preferably, the half hitches are tied in alternate directions above and below the nock, forming the C-shaped release portion 21. The knots on either side of the nock are pulled tight before drawing the bow, and preferably the melting of the rope ends can be carried out after the rope is tied to the bowstring.

Figure 7:
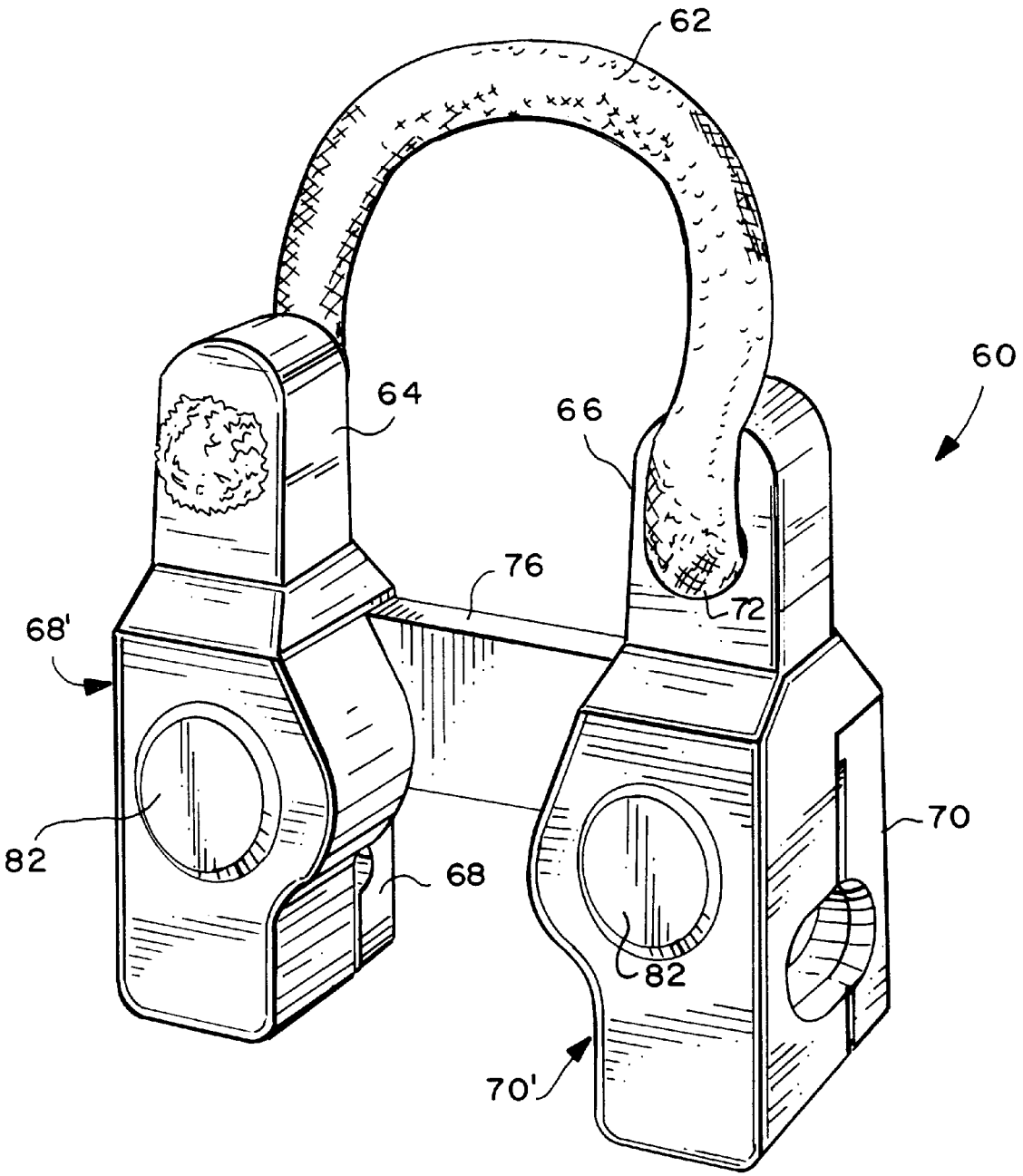
FIG. 7 is a perspective view of a combined bow string nock rope release device in accordance with a second exemplary embodiment of the invention.
Figure 8:
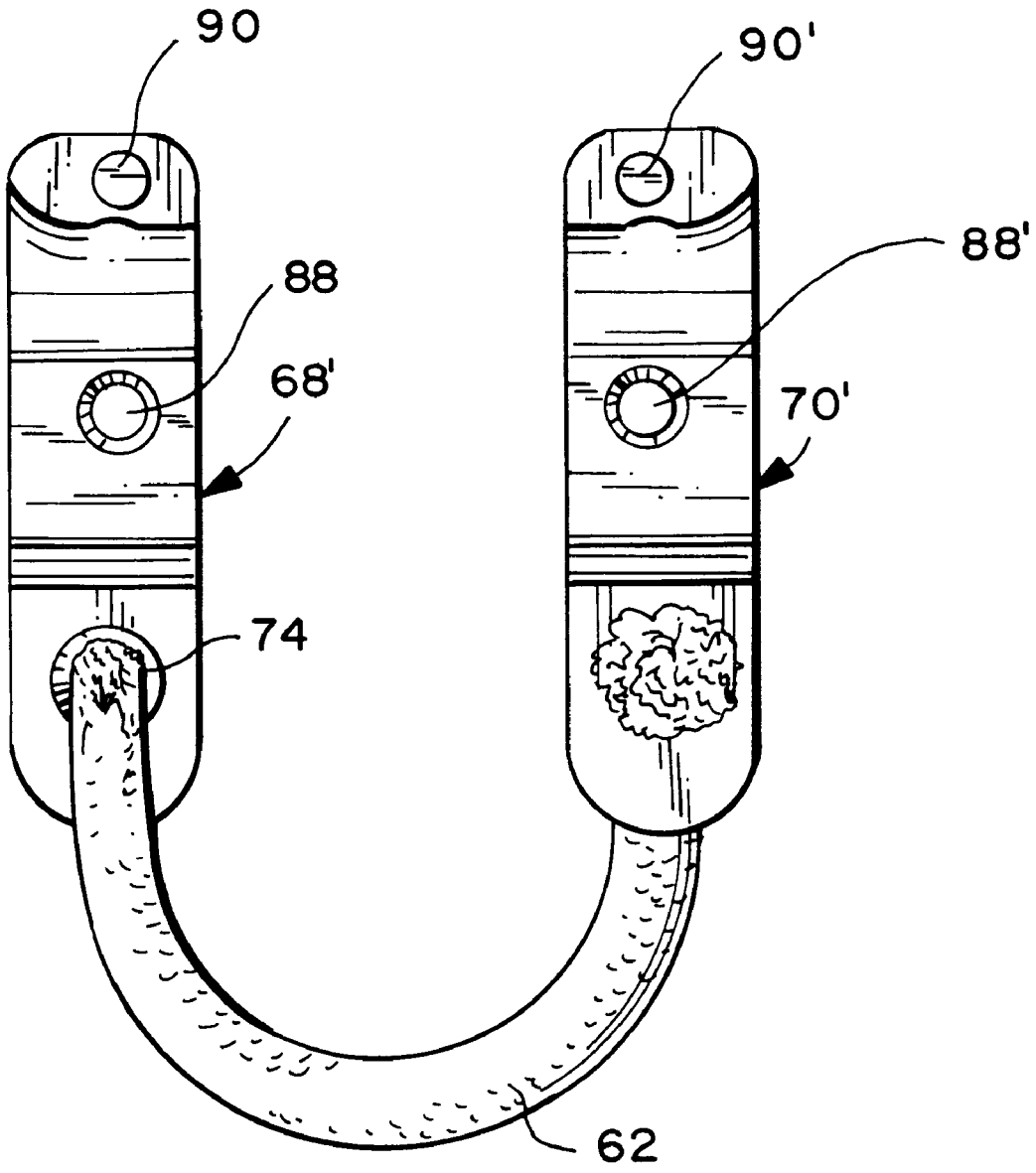
FIG. 8 is a plan view of two removable half clamp sections and the rope release taken from the assembly shown in FIG. 7.

With reference now to FIGS. 7–10, an alternative bowstring nock release loop assembly is shown which is, in effect, a modification of an earlier center nock for a bowstring as described in U.S. Pat. No. 5,499,620, as well as a modification of the assembly shown in FIGS. 1–6. Here, the C-shaped rope release is incorporated into the bowstring nock. More specifically, the nock 60 includes a C-shaped release rope 62, the opposite free ends of which are attached to respective tabs 64, 66 formed on the separable half clamp sections 68', 70', respectively. Each tab 64, 66 is provided with a rope receiving apertures 72, 74, respectively. As best seen in FIGS. 7 and 8, the rope ends are inserted within the holes or apertures 72, 74 in opposite directions with the ends of the loop being melted in the manner previously described to prevent separation of the loop.

Figure 9:
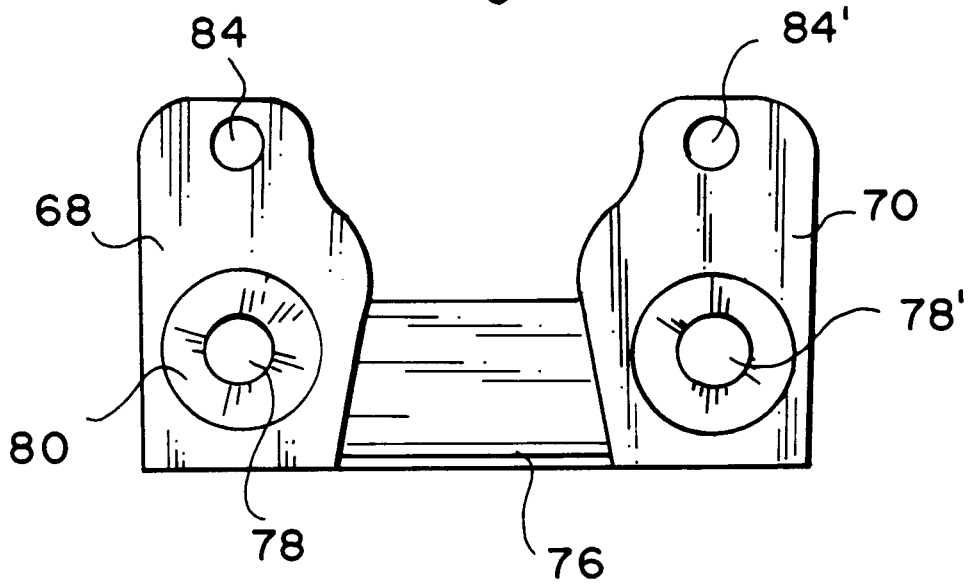
FIG. 9 is a top plan view of the bowstring nock body shown in FIG. 7, but with the separable half clamp sections and rope release removed.
Figure 10:
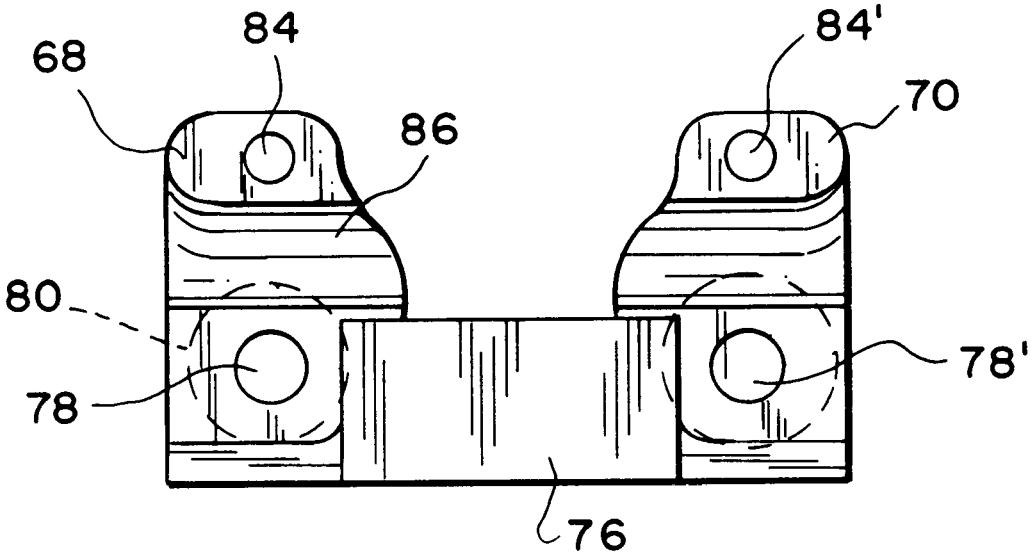
FIG. 10 is a bottom plan view of the bowstring nock body illustrated in FIG. 9.

In this alternative embodiment, the bowstring nock body includes an arrow nock engaging portion or cross-support 76 extending between fixed half clamp sections 68, 70 (FIGS. 9 and 10) in a manner similar to the earlier described embodiment. The manner in which the clamp half sections 68, 68' and 70, 70' cooperate vis-à-vis clamping of the bowstring is, in fact, identical to the earlier described embodiment. The one significant difference relates to the manner of attachment of the respective removable half clamp sections 68', 70' to the mating, fixed half clamp sections 68, 70. With reference to FIGS. 8–10, it will be seen that for each pair of mating half clamp sections, a screw fastener is employed along with an alignment pin. Thus, fixed half section 68 is formed with a screw fastener hole 78 (counterbored at 80 to receive the head of a screw fastener 82) as well as an alignment hole 84, on opposite sides of the half groove 86. Separable half section 68' is formed with a threaded screw fastener hole 88 and a pin 90 adapted to seat within the hole 84.

The nock body and separable half clamp sections 68', 70' are assembled by aligning pins 90 and 90' with holes 84 and 84' and by aligning fastener holes 78, 78' with threaded holes 88, 88', respectively. Screw fasteners 82 are used to secure the assembly as previously described. Of course, prior to assembly, the bowstring will first be seated within the clamping grooves. As in the previously described embodiment, when the parts are assembled, the bowstring receiving aperture is not round, but rather, includes at least one "flat" or other irregularity which promotes clamping action. As also previously described, the arrow nock receiving cross support bar is located relative to the bowstring receiving grooves so that the cross bar is located in substantially the same plane as the bowstring and the rope release.

The rope release loops of this invention are lighter and quieter than conventional metal loops. In addition, the nocking point on the bowstring in this second embodiment is not lost when a worn rope loop is replaced.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A bowstring nock and rope release loop assembly for attachment to a bowstring, the assembly comprising:

a bowstring nock having a pair of axially spaced bowstring attachment portions connected by a rigid cross-support; and a rope release loop adapted to be secured to the bowstring at opposite ends of said bowstring nock, closely adjacent said attachment portions.

2. The assembly of claim 1 wherein each attachment portion includes a fixed half section integral with said cross-support and a mating, removable half section.

3. The assembly of claim 2 wherein each of said fixed sections and each of said removable sections is formed with a bowstring receiving groove.

4. The assembly of claim 3 wherein the grooves of a pair of mating half sections form a non-round aperture.

5. The assembly of claim 3 wherein at least one of said bowstring receiving grooves in each pair of mating half sections includes an offset along a length dimension thereof.

6. The assembly of claim 3 wherein at least one of said bowstring receiving grooves in each pair of mating half sections includes an offset along a length dimension thereof.

7. The assembly of claim 2 wherein each pair of half sections are held together by a removable fastener.

8. The assembly of claim 7, wherein means are provided for allowing at least one of said fixed and removable half sections of each pair to flex about the bowstring when secured by said removable fastener.

9. The assembly of claim 1 wherein the bowstring nock is formed of aluminum.

10. In combination with a bowstring, a bowstring nock having a pair of axially spaced bowstring attachment clamps connected by a rigid cross-support; said attachment clamps fixing said bowstring nock to the bowstring, with said cross-support extending substantially parallel to said bowstring; and a length of rope having free ends tied to said bowstring at opposite ends of said bowstring nock to thereby form a substantially C-shaped release loop adapted to be engaged by a release device.

11. The assembly of claim 10 wherein each attachment clamp comprises fixed half section integral with said cross support and a mating removable half section.

12. The assembly of claim 11 wherein each of said fixed sections and each of said removable sections is formed with a bowstring receiving groove.

13. The assembly of claim 11 wherein the grooves of a pair of mating half sections form a non-round aperture.

14. The assembly of claim 11 wherein each pair of half sections are held together by a removable fastener.

15. The assembly of claim 11 wherein means are provided for allowing at least one of said fixed and removable half sections of each pair to flex when clamped about the bowstring.

16. The assembly of claim 10 wherein the bowstring nock is formed of aluminum.

17. A bowstring nock and rope release loop assembly for attachment to a bowstring, the assembly comprising:

a bowstring nock having a pair of axially spaced bowstring attachment portions connected by a rigid cross-support; and a rope release having free ends attached to opposite ends of said bowstring attachment portions.

18. The assembly of claim 17 wherein each attachment portion includes a fixed half section integral with said cross-support and a mating, removable half section.

19. The assembly of claim 18 wherein said free ends of said rope release are secured to tabs formed on said removable half sections.

* * * * *